United States Patent [19]

Salmi

[11] Patent Number: 4,781,821

[45] Date of Patent: Nov. 1, 1988

[54] PROCESS FOR OPERATING A SHORT-BELT TYPE MAGNETIC SEPARATOR

[75] Inventor: Robert W. Salmi, Arbo Township, Minn.

[73] Assignee: USX Corporation, Pittsburgh, Pa.

[21] Appl. No.: 9,309

[22] Filed: Jan. 30, 1987

[51] Int. Cl.[4] ..... B03C 1/22

[52] U.S. Cl. ..... 209/214; 209/223.1; 209/225

[58] Field of Search ..... 209/214, 215, 223.1, 209/223.2, 225, 216, 40

[56] References Cited

U.S. PATENT DOCUMENTS

| | | | |
|---|---|---|---|
| 1,380,871 | 6/1921 | Swart et al. | 209/223.2 |
| 1,453,699 | 5/1923 | Brophy | 209/223.2 |
| 1,529,970 | 3/1925 | Ullrich | 209/223.2 |
| 2,690,263 | 9/1954 | Box et al. | 209/223.1 |
| 3,016,145 | 1/1962 | Spodig | 209/223.2 |
| 4,359,382 | 11/1982 | Morgan | 209/223.2 |
| 4,370,255 | 1/1983 | Bingel | 209/40 |
| 4,451,360 | 5/1984 | Salmi | 209/215 |

FOREIGN PATENT DOCUMENTS

| | | | |
|---|---|---|---|
| 1051752 | 3/1959 | Fed. Rep. of Germany | 209/223.1 |

*Primary Examiner*—Robert B. Reeves
*Assistant Examiner*—Donald T. Hajec
*Attorney, Agent, or Firm*—W. F. Riesmeyer, III

[57] ABSTRACT

The invention is of a process for increasing the productivity and separation efficiency of a short-belt type dry magnetic separator such as is used for separation of magnetic iron ore from gangue. The process includes providing magnets extending in an arc within the pulley head which begins at a location spaced beyond the point where substantially all of the particles are thrown off of the belt surface in the direction of belt travel.

9 Claims, 2 Drawing Sheets

550 fpm
T
P
18
12°
b
10
N
S
16
22
(71°)
Non magnetics
Weakly magnetic
Strongly magnetic
12

T
10
C1
C2
X
550 fpm
400 fpm
250 fpm
20
12

PROCESS FOR OPERATING A SHORT-BELT TYPE MAGNETIC SEPARATOR

BACKGROUND OF THE INVENTION

This invention relates to "short" belt magnetic separators having a pulley head with magnets located therein that do not rotate with the pulley head, and particularly to a process for increasing the productivity of such separators.

Two basic types of endless belt magnetic separators are known in the art. In one type, called disc-type separators, the pulley head has magnets that rotate with the head. Previous testing of this type of separator has demonstrated that a capacity of approximately 30 to 35 long tons per hour per foot of magnet width (ltphpfmw) can be achieved with minus 1-inch magnetic taconite ore from USS's Minntac mine near Mountain Iron, Minn. With this type of magnetic separator, the strongly magnetic particles form magnetic floccules as they are "grabbed and held" until they are carried out of the magnetic field by the movement of the belt. To minimize the entrapment of non-magnetic particles within magnetic floccules, the layer of particles must be thin and, therefore, the capacity is low. In the other, "short" belt separator, the magnets are stationary during separator operation. I refer to this type as an "ore-agitating" type of separator because the magnetic particles (which are little magnets themselves) reorient and flip 180° as they pass by the fixed internal magnets of alternating polarity. The magnets in this latter type of separator may be adjustable to various positions within the head but do not rotate with it. The term, "short" belt, arises from the restrictions on belt length due to the type of bearings required for the pulley of this type separator. The productivity or throughput of material on short belt separators has been somewhat limited due to the manner in which such separators are conventionally used. Under the theory of operation used in the past, it was thought to be necessary to maintain the magnetic ore particles in the magnetic field on the belt for at least a portion of the time in which the belt passes over the pulley head. Thus, conventional practice has been to operate the belt at a sufficiently slow speed so that the magnetic particles are not released from the magnetic field until they are turned downwardly in a shorter trajectory than the non-magnetic gangue particles to assure effective separation by splitters or baffles located outwardly of and beneath the upper level of the pulley head. Manufacturers of the short-belt, "ore-agitating" type of head pulley show in their catalogs a capacity on the order of 9 to 21 ltphpfmw at belt speeds of 250 to 490 feet per minute (fpm) for magnetic iron ores similar to the taconite ore mentioned above. Conventional magnetic head pulley designs have typically 5 to 9 pole pieces of alternating polarity magnets in a magnetic arc of about 120 to 180 degrees. The interpole design has (in addition) small bucking magnets between each pole piece. When a typical short-belt, dry magnetic head pulley separator is operated at a low speed, i.e. 250 to 400 fpm for a 48-inch diameter drum, none of the particles (magnetic or non-magnetic) leave the belt adjacent to the drum surface until they have undergone significant agitation by passing over several magnet poles of alternating polarity. At these conditions, the magnetic particles form magnetic floccules that entrap non-magnetic particles. In addition, the band of ore particles thrown from the belt is narrow and the exact splitter-position between magnetics and non-magnetics is very critical and gives variable results when the belt speed is low.

It is a primary object of this invention to increase the rate of productivity and separation efficiency of short-belt type magnetic separators having a pulley head with magnets located therein that do not rotate with the pulley head.

SUMMARY OF THE INVENTION

This invention is of a process for separating magnetic ore particles from non-magnetic particles using a short belt type magnetic separator having a pulley head with magnets located at fixed positions therein during operation of the separator. The process includes feeding a mixture of magnetic ore and non-magnetic particulate materials onto a feed end portion of an endless belt of said short belt type magnetic separator. The method includes providing magnets within the pulley head extending along an arc beginning at a location slightly beyond the point of tangency where substantially all of the particles are thrown off of the belt surface so that the magnetic particles are subsequently drawn back toward the belt surface and projected in a shorter trajectory than the non-magnetic particles in order to obtain a more effective separation from said non-magnetic particles than when the particles are not projected at the point of tangency.

DESCRIPTION OF THE PREFERRED EMBODIMENT

Figure 1:
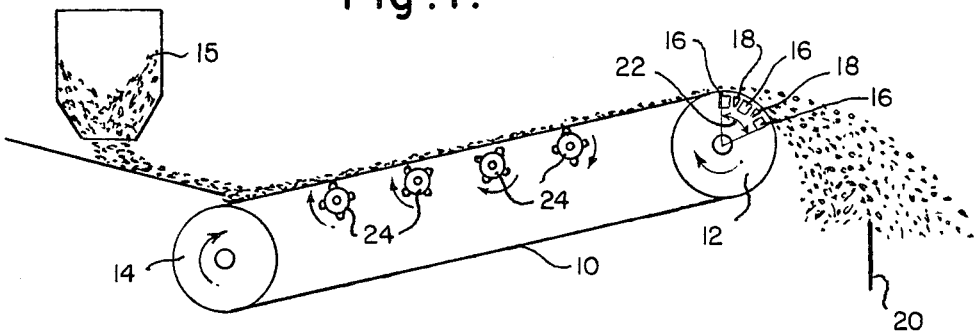
FIG. 1 is a schematic side elevational representation of a short belt type magnetic separator.
Figure 4:
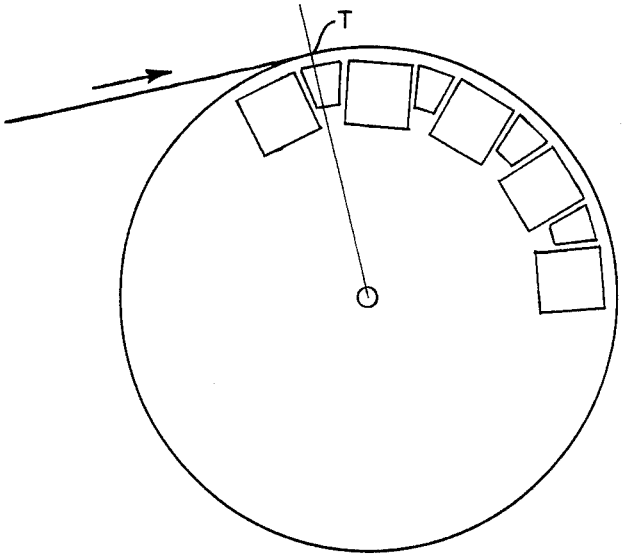
Fig. 4. Prior Art
FIG. 4 is a view similar to FIG. 2 showing the conventional number of magnets contained in the pulley head and the normal adjusted position of the magnets according to prior art operation of a short-belt type magnetic separator.
Figure 5:
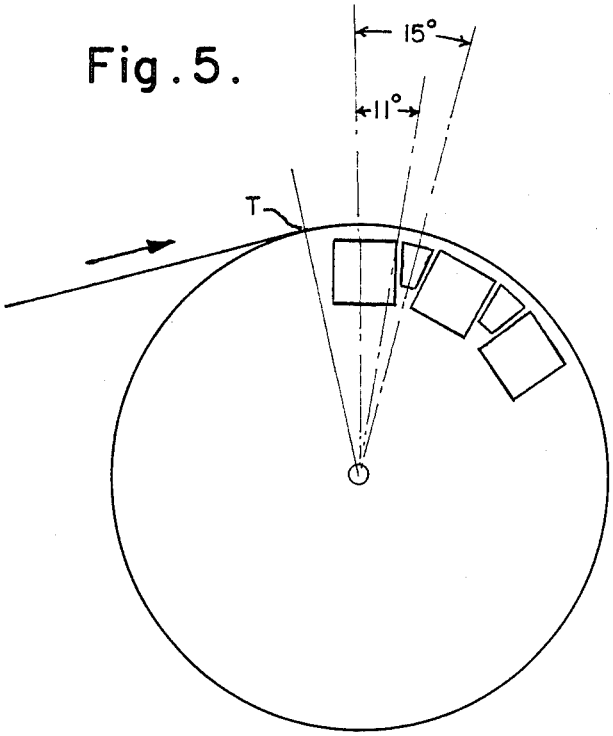
FIG. 5 is a view of a pulley head containing a lesser number of magnets than the one shown in FIG. 4 with the magnets adjusted to a position for practicing the process of the present invention.
Figure 2:
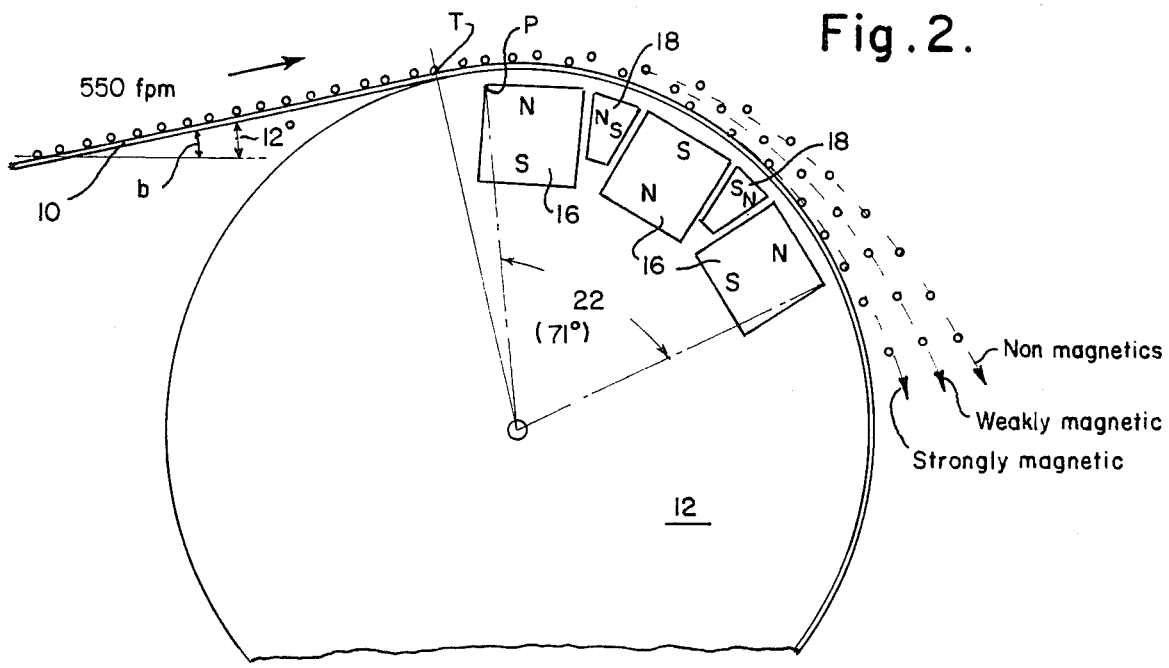
FIG. 2 is an enlarged side elevational view of the pulley head at the exit end of the separator of FIG. 1 showing the preferred number of magnets contained in the pulley head and the adjusted position of those magnets for practicing the process of the present invention.
Figure 3:
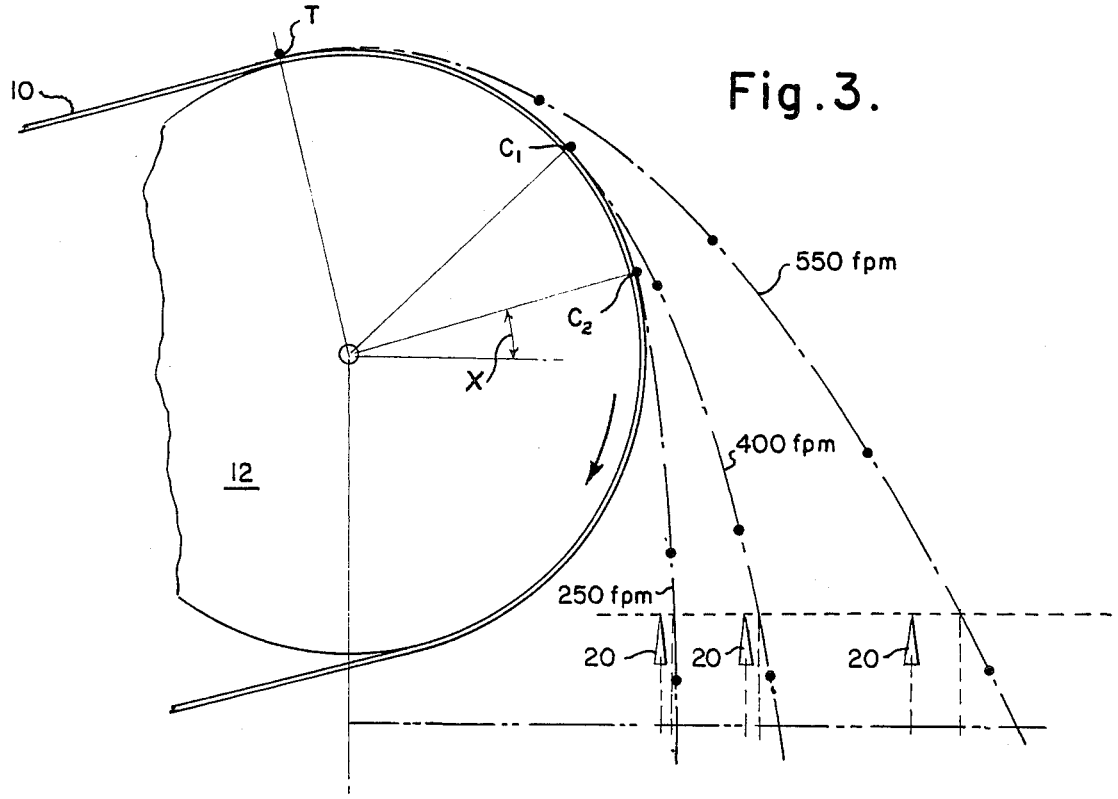
FIG. 3 is a view similar to FIG. 2 showing the effect of belt speed on the trajectory of non-magnetic particles and the effect on splitter position.

Referring to FIG. 1, a typical short-belt type ore-agitating magnetic separator includes an endless conveyor belt 10 mounted on a head pulley 12 and a tail pulley 14. Magnetic ore particles including gangue are fed from a hopper 15 onto a feed end of the belt. A baffle or splitter 20 is provided at spaced positions below the midpoint of pulley head 12 to separate magnetic ore particles from the gangue. A plurality of axial-pole magnets 16 of alternating polarity are mounted within the drum of head pulley 12. Interpole magnets 18 are located between the axial-pole magnets for a purpose described below. The magnets are typically adjustable so that the position of the "magnetic arc" 22 may be selected according to various factors, such as the type of ore, particle size and belt speed used. The magnets are left in the fixed adjusted position during separator operation. In prior art, the magnets are adjusted to the position shown in FIG. 4. FIG. 3 shows the effect of belt speed on the trajectory of one-inch diameter non-magnetic particles from a nominal 48-inch diameter head pulley having a one-half inch thick belt thereon with the belt inclined upwardly at an angle of 12 degrees with respect to a horizontal direction. The various baffle or splitter positions which can be used to obtain an effective separation of magnetic and non-magnetic particles are illustrated for the various belt speeds. With the magnets in the position according to the prior art as shown in FIG. 4, the point at which non-magnetic particles leave the belt can be found from the following: First, a factor F is calculated from the relation $F=v^2/(g\ R\cos b)$ where R is the radius in feet as measured from the axis of the head pulley to the middle of the particle on the belt (i.e. the radius of discharge circle), v=belt speed in feet per second, g is the acceleration due to gravity 32.2 feet per second, and b is the belt incline angle in degrees. If the factor F is calculated to be equal to or greater than 1.0, then the particle leaves the belt at point T where the belt becomes tangent to the head pulley. If the factor F is less than 1.0, then the particle leaves the belt at a point C which will vary with the belt speed. For example, the point $C_2$ (for a belt speed of 250 fpm) may be found by calculating the angle X (FIG. 3) between a radius at point $C_2$ and a horizontal direction. The angle X is found from the relation sine $X=v^2/(g\ R)$. The aforementioned calculations determine where a non-magnetic particle leaves the belt and begins its trajectory therefrom with the magnets in the position shown in FIG. 4, or in the absence of any substantial influence of a magnetic field where, based on belt speed and angle of inclination of the belt, substantially all of the particles leave the belt. However, with the magnets adjusted to the position shown in FIG. 4, magnetic particles will remain on the belt slightly longer and for greater arc distances than the arc for non-magnetic particles. In the prior art relatively slow belt speeds have been used (250 to 490 fpm) with the magnets in the adjusted position of FIG. 4 so that magnetic particles entered the magnetic field before leaving the belt surface. Thus, in the prior art, magnetic particles were intentionally retained on the belt past the point where non-magnetic particles left the belt surface. Also by arranging the magnets with poles of alternating polarity adjacent to the belt, the magnet particles were caused to "flip" and reorient themselves while they travelled on the belt to a point slightly beyond point C described above. The purpose of causing the particles to flip as just mentioned was to permit smaller non-magnetic particles which tended to become entrapped within floccules of the magnetic particles to separate and fall out during reorientation of the particles so that a better separation could be obtained. However, in actual practice it is believed that magnetic floccules made up of many magnetic and non-magnetic particles flip as a floccule rather than an individual particle so that the non-magnetic particles are not separated as expected. An alternate magnet design illustrated in FIG. 2 includes "interpole" magnets 18 positioned between each axial pole magnet 16. Interpole magnets have the same polarity on their side surfaces (in the radial direction) as their adjacent axial poles. This design results in a magnetic field that extends further out from the pulley than other magnet designs. This tends to accentuate the degree of flip and reorientation of the magnetic particle floccules.

According to this invention, a process is provided for more effectively separating magnetic ore particles from non-magnetic particles using a short-belt type, ore-agitating magnetic separator. The process also provides significantly increased production rates (my experience showed a 400 to 500% increase in capacity compared to the prior art) for the magnetic separation of ores using such separators. An essential feature of the invention is that the magnets within the pulley head must be located in a position such that the magnetic arc begins beyond the point where, based on belt speed and angle of inclination, substantially all of the particles are thrown off of the belt surface. Specifically, the magnets should be located such that a radius extending from the axis of the pulley head through the closest effective point P (FIG. 2) of the magnet adjacent to the point where the particles leave the belt should make an angle of at least 1° in a downstream direction with respect to a radius through said point where the particles leave the belt. Desirably, the angle should be within a range of about 1° to 10° and preferably within a range of 2° to 6°.

To increase the rate of production, it is desirable to operate the separator at higher than normal belt speeds. Desirably, the belt travel speed should be as high as possible to increase production capacity. However, the maximum travel speed of the belt should be less than that at which the centrifugal force imparted to the magnetic particles becomes equal to or higher than the magnetic attractive force that pulls the magnetic particles back toward the belt surface. Preferably, the minimum belt speed should be high enough so that substantially all of the particles are thrown off of the surface of the belt at the point of tangency T. Also, the angle of inclination b of the belt for a particular travel speed should not exceed that at which substantially all of the particles come to rest on the belt (i.e. get up to belt speed) prior to arriving at the point of tangency T so that the degree of separation obtained is not significantly decreased. By substantially, I mean all of the particles except those which contain more than 4 or 5 percent moisture. It is desirable that the particles should not contain more than 1 or 2 percent moisture. Desirably for treatment of magnetic taconite ore, the belt should be inclined at an angle within the range of 0 to 16 degrees, preferably 12 to 14 degrees. It is also desirable that at least one and preferably two changes in polarity should be provided within the magnetic arc. Preferably, the first change in polarity with respect to the direction of travel should be located on a radius making an angle within the range of 10° to 25°, more preferably 12° to 18° with respect to the point where the particles leave the belt. Finally, a smaller magnetic arc may be used than was used in the prior art. Preferably, for a more economic design of separator, the magnetic arc provided should be within the range of 50° to 90°.

Finally, it is desirable to feed the particles on the belt at a rate and in a manner so that a relatively uniformly spread thin "bed" thickness is obtained. Preferably, the belt is agitated, e.g. by bouncing idler rolls 24 as claimed in U.S. Pat. No. 4,370,225, the specification of which is incorporated herein by reference. Such agitation permits finer particles to settle through the bed onto the belt so that fine magnetic particles are not lost with the large non-magnetic particles because they are lying on top of them when they reach the point of discharge. In the most preferred form, the belt consists essentially of a monolayer, one particle in depth. A significant advantage of the invention is that higher production rates can be achieved with a broader range of particle sizes than was possible previously. For example, it is not necessary to perform the separation in more than one step by segregating the particles into more than one size range to accomplish an efficient separation. A high degree of efficiency can now be obtained by a single pass through the separator on feed containing particles over a broad size range.

I claim:

1. A process for separating magnetic ore particles from non-magnetic particles using a short belt magnetic separator having a pulley head with axial pole permanent magnets located within said pulley head, said magnets being mounted in a fixed position within said pulley head during operation of said separator and generating a magnetic field said process comprising:

feeding a mixture of magnetic and non-magnetic particulate materials onto a feed end portion of an endless belt of said short belt magnetic separator, positioning said axial pole magnets within the pulley head so that said magnets extend along an arc beginning at a location spaced at least one degree beyond the point of tangency T of an upper surface of the belt with the pulley head projecting both the magnetic and non-magnetic particles off the belt at the point of tangency T by operating the belt at a speed and angle of inclination sufficient therefor, and drawing the magnetic particulates by said magnetic field back toward the belt after they have been projected therefrom so as to obtain a more effective separation of said magnetic and non-magnetic particles than when said magnetic particles are not projected from the belt at said point of tangency.

2. The process of claim 1 wherein in said operating step the maximum travel speed of the belt is less than that at which the centrifugal force imparted to the magnetic particles becomes equal to or higher than the magnetic attractive force that pulls the magnetic particles back toward the belt surface.

3. The process of claim 2 wherein in said operating step the angle of inclination b of the belt for a particular travel speed does not exceed that at which substantially all of the particles come to rest on the belt prior to arriving at the point of tangency T so that the degree of separation obtained is not significantly decreased.

4. The process of claim 3 wherein said magnetic ore particles are comprised of magnetic taconite ore and in said operating step the angle of inclination of said belt is within a range of 0 to 16 degrees.

5. The process of claim 4 further comprising providing at least one reversal of polarity in the magnetic field emitted by the magnets in said arc, said reversal of polarity being accomplished by aligning the magnets with like poles of adjacent magnets aligned at 180 degrees with respect to each other, said reversal of polarity being at a location on a radial direction making an angle within the range of 12 to 18 degrees with a radius of the pulley head through said point of tangency.

6. The process of claim 5 wherein said positioning step includes providing said magnets so that said arc bgins at a location which makes an angle within the range of 2 to 6 degrees with respect to a radial direction through said point of tangency.

7. The process of claim 6 wherein said operating step includes operating said belt at an angle of inclination within the range of 12 to 14 degrees and said providing step includes providing at least two spaced apart reversals of polarity in the magnetic field emitted by the magnets in said arc.

8. The process of claim 7 wherein said magnets are provided so as to extend in an arc within the range of 50 to 90 degrees with respect to said pulley head.

9. The process of claim 7 further comprising mechanically vibrating said belt so as to stratify the particles by size thereon and spread the particles in a layer of essentially uniform thickness on the belt.

* * * * *